US006024252A

United States Patent [19]

Clyde

[11] Patent Number: 6,024,252

[45] Date of Patent: Feb. 15, 2000

[54] DISPENSER SYSTEM

[75] Inventor: Gene Frank Clyde, New Milford, Conn.

[73] Assignee: Nestec S. A., Vevey, Switzerland

[21] Appl. No.: 08/971,030

[22] Filed: Nov. 14, 1997

[51] Int. Cl.[7] ..... B65D 35/56

[52] U.S. Cl. ..... 222/105; 222/214

[58] Field of Search ..... 222/105, 183, 222/185.1, 212, 214, 94; 141/85

[56] References Cited

U.S. PATENT DOCUMENTS

| | | | |
|---|---|---|---|
| 3,881,641 | 5/1975 | Pliml, Jr. et al. | 222/214 |
| 3,986,507 | 10/1976 | Watt | 128/214 |
| 4,023,607 | 5/1977 | Jensen et al. | 150/1 |
| 4,112,989 | 9/1978 | Grode et al. | 150/1 |
| 4,150,744 | 4/1979 | Fennimore | 206/205 |
| 4,228,835 | 10/1980 | Robinson et al. | 150/8 |
| 4,334,640 | 6/1982 | van Overbruggen et al. | 222/207 |
| 4,463,876 | 8/1984 | Swallert | 222/105 |
| 4,465,487 | 8/1984 | Nakamura et al. | 604/408 |
| 4,513,885 | 4/1985 | Hogan | 222/105 |
| 4,516,977 | 5/1985 | Herbert | 604/415 |
| 4,561,110 | 12/1985 | Herbert | 604/408 |
| 5,042,682 | 8/1991 | Ritter et al. | 222/185.1 |
| 5,249,706 | 10/1993 | Szabo | 222/20 |
| 5,342,345 | 8/1994 | Spencer | 604/408 |
| 5,449,027 | 9/1995 | Mueller | 141/85 |

FOREIGN PATENT DOCUMENTS

| | | |
|---|---|---|
| 1179992 | 12/1984 | Canada . |
| 0 117 509 | 2/1984 | European Pat. Off. . |
| 0 246 052 A1 | 11/1987 | European Pat. Off. . |
| 2561229 | 9/1985 | France . |
| 29 33 375 A1 | 3/1981 | Germany . |
| 35 05 957 A1 | 8/1986 | Germany . |
| WO 97/07024 | 2/1997 | WIPO . |

*Primary Examiner*—Andres Kashnikow
*Assistant Examiner*—Dinh Q. Nguyen
*Attorney, Agent, or Firm*—Pennie & Edmonds LLP

[57] ABSTRACT

A dispenser system for dispensing a liquid food or drink product from a flexible pouch, wherein the system includes a housing configured and adapted for receiving a flexible pouch, a flexible pouch adapted to contain a liquid food or drink product, the pouch having a built-in dispensing tube with an inlet and an openable outlet, and a valve system adapted for engaging with the dispensing system externally between its inlet and its oulet so as to control the dispensing of liquid food or drink product from the pouch upon opening of the tube outlet. The invention is further directed to a method for dispensing a liquid food or drink product using the dispenser system and a flexible pouch for use in the system, wherein the pouch contains an aseptically filled liquid food or drink product and has a built-in dispensing tube with an inlet and an openable outlet, wherein the pouch and the dispensing tube are sterilized prior to filling.

13 Claims, 2 Drawing Sheets

DISPENSER SYSTEM

FIELD OF INVENTION

The present invention relates to a dispenser system for dispensing a liquid food or drink product from a flexible pouch.

BACKGROUND FOR THE INVENTION

It is well known to sell drinks such as wine in a disposable pouch-in-box package. In such packages, the pouch is provided with an integrated valve system arranged to control the dispensing of the product from the pouch. The valve system is disposable with the box when the pouch is emptied. Typically, a full pouch contains from 5 to 10 liters of the product. The box gives support to the pouch. Such valve systems are generally expensive. The pouch-in-box type of package is usually only used for acid products due to its short shelflife once the pouch has been opened.

Aseptic packing is a well-known technique used to prolong the shelf life of food or drink products. Fundamentally, the principle of the aseptic packing technique is based on filling and sealing the product in packages under sterile or bacteria-free conditions, in order to create the best possible circumstances for transportation and storage of the product e.g. without need for cold storage. For the shelf life to be as long as possible, both the product and the packing material are sterilized and the filling of the product in the package is under conditions avoiding re-infection of the product.

The aseptic packing technique is e.g. used for packing of liquid food or drinks in pouches when a prolonged shelf life is desired. In a dispenser system, for convenient dispensing of the product, the pouch is provided with a port adapted for receiving a dispensing device such as an opening/closing mechanism or simply a dispensing tube.

In a dispensing system the attachment of a dispensing device to the port of a pouch is a suitable way to assist in emptying the liquid product from the pouch. However, upon attachment of a dispensing device to the pouch the integrity of the pouch is violated and there is a risk that bacteria on the dispensing device may contaminate the content of the pouch and the product passing through it. The risk of contamination is also increased if the product is sucked back into the pouch. This may not have a major influence if the pouch is to be emptied shortly after opening. Also if the product in the pouch e.g. is acid with for example a pH at 4.6 or below it may be stable for a while after breach of the integrity of the package. Acid products are e.g. ketchup, mustard, concentrated fruit juice etc. However, if the pouch contains a non-acidified product, connecting a foreign member to the pouch and product, the life of the product may be considerably lowered due to contamination. An example of a non-acid product is fluid milk or unfrozen ice cream mix.

Current aseptic pouches are filled aseptically, but for dispensing, a dispensing tube with fitment is attached to the pouch at point of use e.g. at a pre-fixed port on the pouch. Such an attachment may contaminate the product in the pouch. If the product is a non-acid it must be maintained under refrigeration to ensure the life of the product.

SUMMARY OF THE INVENTION

An aim of the present invention is to provide a dispensing system for dispensing a liquid product from a pouch, in particular a ready-to-drink product, without substantial contamination of the product remaining in the pouch.

A further aim is to provide a low cost pouch, which may be used, for dispensing a ready-to-drink product improving the shelf-life of the product after opening by reducing the contamination of the product in the pouch.

In a first aspect, the invention relates to a dispenser system for dispensing a liquid food or drink product from a flexible pouch comprising

- a housing capable of receiving a flexible pouch,
- a flexible pouch for a liquid food or drink product having an built-in dispensing tube with an inlet and an openable outlet, and
- a valve system capable of engagement with the dispensing tube externally between its inlet and its outlet so as to control the dispensing of liquid food or drink product from the pouch upon opening of the tube outlet.

According to the invention it has surprisingly been found that liquid food or drink products such as a ready-to-drink product may be aseptically dispensed without violating the integrity of the packaging or contaminating the food material in the packing. According to the invention, the valve system is capable of engagement with the dispensing tube so as to open and close the flow of product through the tube upstream of the outlet of the dispensing tube, thus enclosing the product prior to its reaching the outlet where contamination may occur. The valve system is operated without contacting the product from the exterior. The pinching or crimping of the tube prevents leakage of the product out of the pouch and ingress of micro-organisms. It has also been found that the product pressure, although slight, tends to result in a one-way flow away from the pouch when the valve or crimp is released. In addition, it has been found that as it is possible to build in a dispensing tube or attach such a dispensing tube to a pouch prior to sterilization thereof the above discussed problem with shelf-life and contamination may be overcome.

A further advantage of the dispensing system according to the invention is that there is little need for cleaning the valve system, when replacing the pouch for example, as the valve system is not in direct contact with the product being dispensed.

According to the invention, the pouch may be provided with a tube of a flexible material capable of being squeezed to close the tube flow of the liquid food or drink product through the tube and capable of substantially retaining its shape in order to re-open the flow through the tube. The valve system may, in this embodiment of the invention, be arranged to perform these squeeze and release manipulations of the dispensing tube.

In a preferred embodiment of the invention the valve system clamps and releases the dispensing tube. This is conveniently done by a weighted or spring-loaded crimping device, which is operated manually by the user. The pressure from the load or crimping device to the tube should be sufficient to block flow without puncturing or permanently deforming the tube.

If the dispensing system is to be used in a bigger outlet, it may be desirable to provide a valve system, which is capable of portion control. This is preferably done by means of a non-product-contact peristaltic pump.

In order to extend the life of the product in the pouch and to allow a non-refrigerated distribution and storage of it, the pouch and dispensing tube are preferably sterilized prior to filling. The sterilization is advantageously done by means of irradiation. Furthermore, it is preferred that the pouch is aseptically filled with liquid food or drink product for the reasons above-discussed.

The dispensing tube may be an integral part of the pouch material. Alternatively, if different material properties are desired for the tube, the dispensing tube may conveniently be heat-sealed onto the pouch. In either case, the outlet end of the tube is capped or heat-sealed shut for security until the tube is arranged in the valve or crimping device, at which time it can be opened.

A preferred pouch material is an oxygen/water barrier material. A suitable material is a plastic laminate with an approved food contact material layer. Advantageously, the material is a beat-sealable film with an oxygen/water barrier layer and preferably with an outer layer having good wear and flexibility properties. Examples of suitable outer layers are nylon, either linear or biaxially orientated, polyethylene, polypropylene, and polystyrene. Examples of oxygen/water barrier materials are ethylene vinyl alcohol (EVOH) and silicon oxide. Examples of heat-sealable material are polyethylene e.g. linear low density, ultra linear low density, high density or metallocene catalyzed polyethylene. A preferred material combination is laminate of Nylon co-polymer, on the outside, EVOH, and metallocene catalyzed polyethylene on the inside. The layers in the laminate are adhered together. When the tube is not an integrated part of the pouch, anti-block additives should be avoided to ensure good pouch-edge/tube fusion.

The tube material should be made of a material that is sufficiently soft that it allows closure of the tube when subjected to a certain load, but on the other hand does not puncture or permanently deform when squeezed or crimped. A suitable material is a co-extruded Metallocene catalyzed polyethylene. Such material may e.g. be made from Metallocene catalyzed resin from Dow Chemical Corporation, e.g. Dow AG 8180. The tube is conveniently hermetically heat sealed crimped onto the pouch material. It is important that the tube and pouch material be compatible for heat sealing.

The dimensions of the tube can be adapted to the type of food material and valve system chosen. However, generally it is preferred that the internal diameter of the tube be from 5 to 15 mm, more preferably about 7 to 8 mm. The suitable material thickness depends on the material chosen. For a material of the above-mentioned type, an appropriate material thickness is e.g. from 1 to 2 mm, preferably about 1.5 mm. The length is suitably about 15 to 25 cm depending on the construction of the housing for receiving the flexible pouch and the position of the valve system.

Depending on the design of the housing of the dispenser system, it may be desirable for the pouch to be arranged in a box capable of being received in the housing. The box may e.g. be a cardboard box. The box may be provided with an opening allowing the dispensing tube to be pulled out of the box. Alternatively, the box is provided with perforations allowing part of the box to be removed to give access to the dispensing tube.

A further advantage of the invention is that the same product may even remain shelf-stable in the opened bag, whether refrigerated or not, for a period depending on the type of product.

It has been found that the present invention is particularly useful for ready-to-drink product dispensers, in particular for non-acid products such as those which are generally difficult to preserve upon opening of the package, for example, for drinks such as milk-containing drinks, cocoa-based drinks, malt based drinks, iced-tea, iced-coffee, sauce e.g. cheese and milk or meat based sauce, gravies, and nutritional drink supplements etc. The dispensing system is also particularly suitable for dispensing concentrates for the making of the beverages or food products. The invention allows the above-mentioned products to be distributed and stored at an ambient temperature and allows the product to remain shelf-stable even after opening of the pouch, whether refrigerated or not. However, for certain products it may be desirable to refrigerate the product to provide a better taste.

The dispensing tubes openable outlet may be opened by simply cutting the tube with a knife or scissors. Alternatively, an openable seal or cover, which can be manually torn, may be provided. There is no need for attaching the outlet of the tube to any type of outlet fitment or re-closing of the tube outlet; the product can be dispensed directly from the outlet of the tube and into e.g. a cup, bowl etc.

In a second aspect, the invention relates to the use of a flexible pouch comprising a liquid food or drink product and having a built-in dispensing tube with an inlet and an openable outlet in a drink dispenser system, wherein the dispenser system comprises a housing capable of receiving a flexible pouch, and a valve system capable of engagement with the dispensing tube externally between its inlet and its outlet so as to control the dispensing of liquid food or drink product from the pouch upon opening of the tube outlet. This is done without contacting the valve and the food product. Suitable characteristics of the pouch design, manufacturing and product are described above.

In addition, the invention relates to a flexible pouch comprising an aseptically processed and/or filled liquid food or drink product and having a built-in dispensing tube with an inlet and an openable outlet, the pouch and the dispensing tube being sterilized prior to filling. The flexible pouch is preferably of the above-discussed type.

BRIEF DESCRIPTION OF THE DRAWINGS

The invention will now be described with reference to the accompanying drawings, by way of example only, in which.

DETAILED DESCRIPTION OF THE INVENTION

Figure 1:
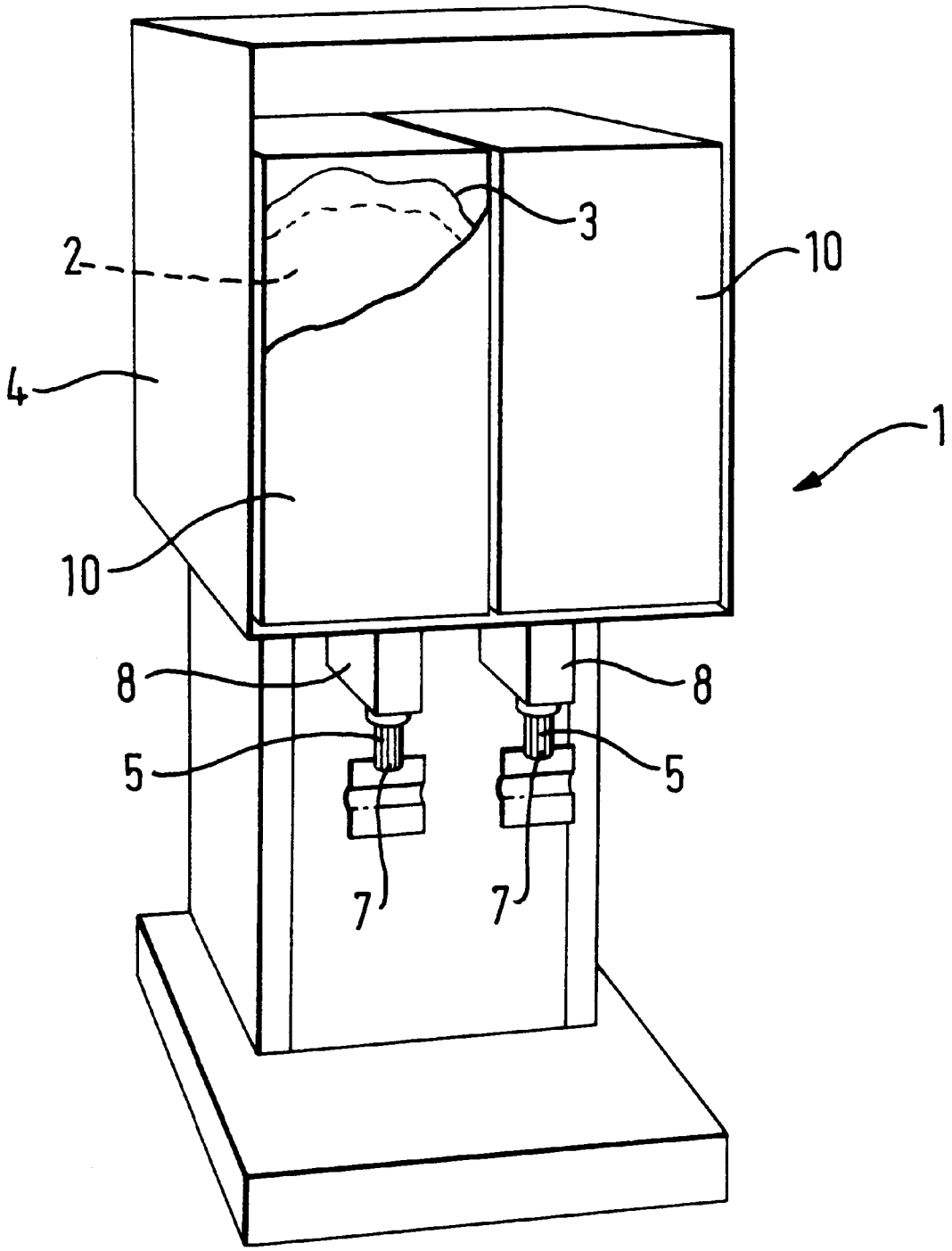
FIG. 1 is a schematic and perspective drawing of a dispenser system in accordance with the invention.

FIG. 1 shows a dispenser system 1 for dispensing a liquid food or drink product 2 from a flexible pouch 3. The dispenser system has housing 4 capable of receiving the flexible pouch 3. The housing 4 shown in FIG. 1 is a metal housing, however, it may be made of other rigid materials. The housing 4 supports the pouch 3 during dispensing of the liquid food or drink product 2.

Figure 2:
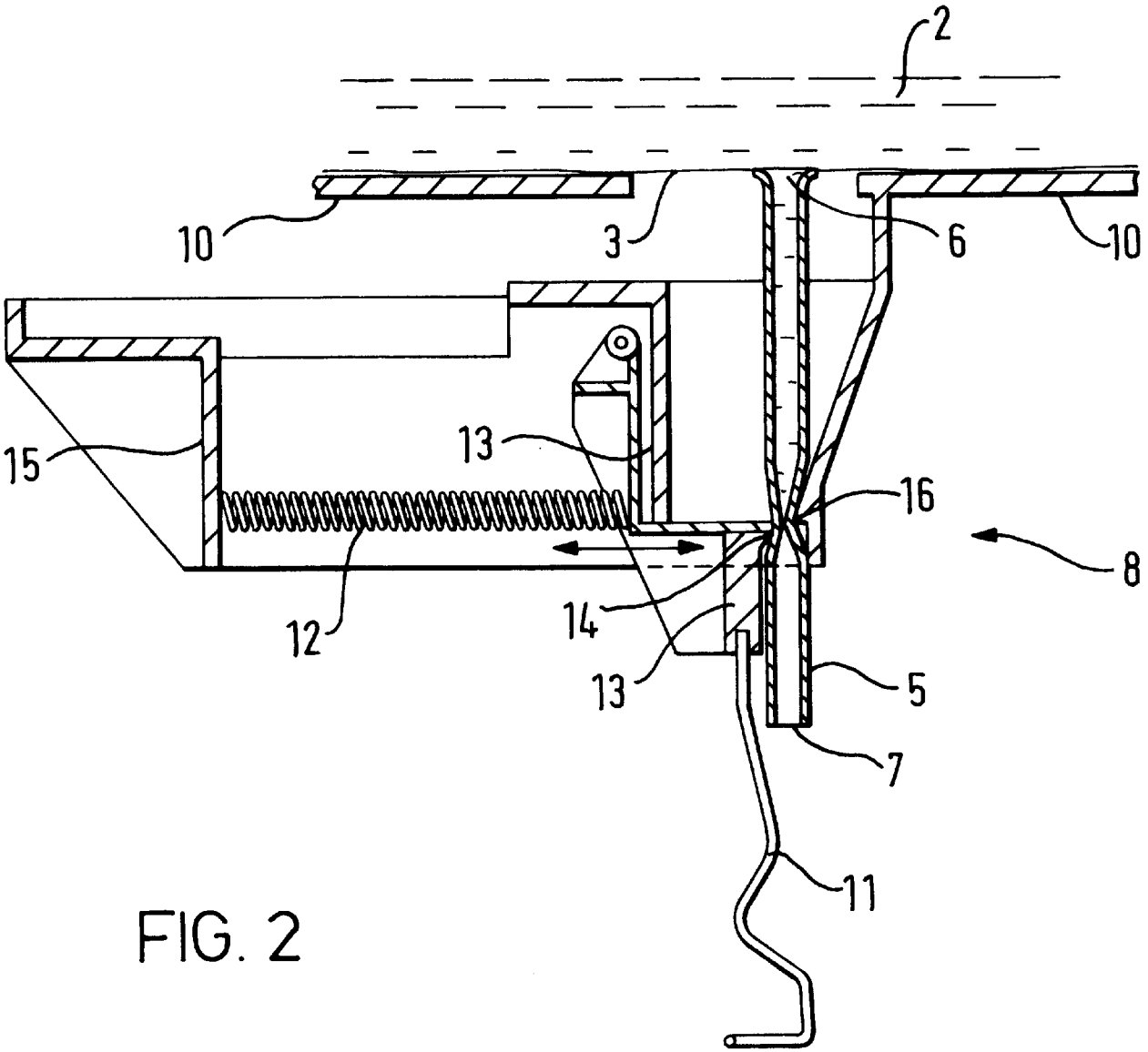
FIG. 2 is a side sectional view through a preferred embodiment of the valve system.

The flexible pouch 3 for a liquid food or drink product 2 has a built-in dispensing tube 5 with an inlet 6, see FIG. 2, and an openable outlet 7. When arranging the flexible pouch 3 for dispensing of the liquid food or drink product 2 the dispensing tube projects out of the housing 4. The tube 5 is heat-sealed to the pouch material. Conveniently the pouch 3 is arranged in a box 10 capable of being received in the housing 4. This allows for an easy placing and replacing of the pouch 3. In FIG. 1 the box is partly cut away to show the pouch 3 with the product 2.

The dispensing system 1 also has a valve system 8 capable of engaging with the dispensing tube 5 between its inlet 6 and its outlet 7 so as to control the dispensing of liquid food or drink product from the pouch upon opening of the tube outlet. The valve system 8 is capable of portion control by means of a non-product-contact peristaltic pump 9, not shown in the drawings.

FIG. 2 shows a preferred embodiment of the valve system 8. A pouch 3 in a box 10 has a tube 5 projecting out of an opening in the box 10. The tube 5 is formed of a flexible material capable of being squeezed to prevent flow of the product 2 through the tube, and substantially retaining its shape in order to re-open the flow through the tube. In FIG. 2 the tube is shown in a squeezed position.

The valve system 8 provides a clamping and releasing of the dispensing tube 5 by means of a spring-loaded movable mounted member 13. The spring-loaded movable member 13 is arranged in a support 15 and has a front clamping end 14 engaging with the tube, which again is pressed towards a wall part 16 of the support 15 opposite the clamping end 14.

The spring-load is adapted so that there is sufficient pressure on the tube to squeeze it to a closed position but it is still possible to manually press the spring 12 back when it is desired to dispense the product 2 through the tube 5.

The valve system 8 is operated manually by pressing a receiving container, e.g. a cup, against the member 11 which will release the squeezing pressure on the tube, which will retain its shape and re-open to allow a flow of the product through the tube. Once the pressure on the member 11 is released the tube 5 will close again. In this way, the dispensing of the product 2 in portions can be done while the valve system 8 is only engaging the tube externally. Thus, dispensing can be done while substantially reducing the risk of contamination of the product.

The housing 4 may be provided with a refrigeration system for cooling the product. However, this is not necessary for the life of the product as the valve system does not contact the product from the outside and thus reduces the possibility for contamination of the product.

I claim:

1. A dispenser system for dispensing a liquid food from a flexible pouch comprising:

a housing configured and adapted for receiving a flexible pouch;

a flexible pouch within said housing adapted for containing a liquid food, said pouch comprising a port and a built-in dispensing tube having an inlet and an openable free outlet, the inlet of the tube being integrally sealed to said port of the pouch, and being made of materials that are compatible to be sealed with the pouch and that are responsive to squeezing forces to close the tube inlet and prevent the flow of liquid therethrough, but is sufficiently resilient to return to their original configuration after release of the squeezing forces to permit the flow of liquid therethrough; and a valve system adapted for engaging the dispensing tube externally between its inlet and its outlet so as to control dispensing of liquid food from the pouch upon opening of the tube outlet.

2. A dispensing system according to claim 1, wherein the valve system is adapted to clamp and release the dispensing tube.

3. A dispenser system according to claim 1, wherein the valve system is capable of portion control by means of a non-product-contact peristaltic pump.

4. A dispenser system according to claim 1, wherein the pouch and dispensing tube are sterilized prior to filling.

5. A dispenser system according to claim 1, wherein the pouch and dispensing tube are radiation sterilized prior to filling.

6. A dispenser system according to claim 1, wherein the pouch comprises aseptically processed and filled liquid food or drink product.

7. A dispenser system according to claim 1, wherein the dispensing tube is heat-sealed or crimped shut onto the pouch.

8. A dispenser system according to claim 1, wherein the liquid food product or drink is a non-acid product.

9. A dispenser system according to claim 1, wherein the liquid food or drink product is a drink selected from the group consisting of iced-tea, iced-coffee, malt, cocoa or chocolate drinks, sauces, gravies and nutritional drink supplements or concentrates thereof.

10. A dispenser system according to claim 1, further comprising a box configured and adapted for being received in the housing, within which said pouch is arranged.

11. A dispenser system according to claim 1, wherein the box is provided with a perforation to allow easy opening of the box to allow access to the dispensing tube.

12. A flexible pouch comprising an aseptically filled liquid food a port and a built-in dispensing tube having an inlet integrally sealed to the pouch and an openable outlet; the tube being made of materials that are compatible to be sealed with the pouch and that are responsive to squeezing forces to close the tube inlet and prevent the flow of liquid therethrough, but are sufficiently resilient to return to their original configuration after release of the squeezing forces to permit the flow of liquid therethrough; the pouch and the dispensing tube being sterilized prior to filling.

13. A method for dispensing a liquid food, said method comprising:

disposing a quantity of a liquid food in a dispenser system for dispensing said product from a flexible pouch, said dispenser system comprising:

a housing configured and adapted for receiving a flexible pouch;

a flexible pouch within said housing adapted for containing a liquid food, said pouch comprising a port and a built-in dispensing tube having an inlet and an openable free outlet, the inlet of the tube being integrally sealed to said port of the pouch and being made of materials that are compatible for sealing with the pouch and that are responsive to squeezing forces to close the tube inlet and prevent the flow of liquid therethrough, but are sufficiently resilient to return to their original configuration after release of the squeezing forces to permit the flow of liquid therethrough; and a valve system adapted for engaging the dispensing tube externally between its inlet and its outlet so as to control dispensing of liquid food from the pouch upon opening of the tube outlet; and operating said valve system to dispense a desired quantity of said product.

* * * * *